US008221156B2

(12) United States Patent
Sun

(10) Patent No.: US 8,221,156 B2
(45) Date of Patent: Jul. 17, 2012

(54) RJ-45 CONNECTOR

(75) Inventor: Zheng-Heng Sun, Taipei Hsien (TW)

(73) Assignee: Hon Hai Precision Industry Co., Ltd., Tu-Cheng, New Taipei (TW)

( * ) Notice: Subject to any disclaimer, the term of this patent is extended or adjusted under 35 U.S.C. 154(b) by 50 days.

(21) Appl. No.: 12/947,836

(22) Filed: Nov. 17, 2010

(65) Prior Publication Data

US 2012/0100748 A1 Apr. 26, 2012

(30) Foreign Application Priority Data

Oct. 25, 2010 (CN) ..... 2010 1 0518188

(51) Int. Cl.
*H01R 3/00* (2006.01)

(52) U.S. Cl. ..... 439/490

(58) Field of Classification Search ..... 439/490, 439/79, 344, 354, 357, 676
See application file for complete search history.

(56) References Cited

U.S. PATENT DOCUMENTS 6,457,992 B2 * 10/2002 Posey et al. ..... 439/490
7,194,183 B2 * 3/2007 Thornton et al. ..... 385/139
7,390,212 B1 * 6/2008 Yang ..... 439/490

* cited by examiner

*Primary Examiner* — Khiem Nguyen
(74) *Attorney, Agent, or Firm* — Altis Law Group, Inc.

(57) ABSTRACT

A connector includes a main body, a cable extending from a rear end of the main body, and a light guide post assembly with two spaced light guide posts formed on a top and fixed to the cable adjacent to the main body. A resilient latch is formed on a top of the main body. A back-end of each light guide post extends upward to form a protrusion capable of transmitting light to a top of the light guide post.

12 Claims, 3 Drawing Sheets

RJ-45 CONNECTOR

CROSS-REFERENCE OF RELATED APPLICATIONS

Relevant subject matter is disclosed in a pending U.S. patent application, titled "RJ-45 CONNECTOR," with the application Ser. No. 12/825,339, and in a pending U.S. patent application, entitled "RJ-45 connector," with the application Ser. No. 12/825,309, which are assigned to the same assignee as this patent application.

BACKGROUND

1. Technical Field

The present disclosure relates to a Registered Jack-45 (RJ-45) connector.

2. Description of Related Art

RJ-45 connectors are widely used in network communication. In use, an RJ-45 connector is engaged in an interface of a chassis of a computer or a server. The interface includes two light emitting diodes, used to indicate whether the network connection is working properly. However, in most cases, the interface is defined in a rear end of the chassis, thus light generated by the light emitting diodes is only seen from the back of the chassis, which is inconvenient.

BRIEF DESCRIPTION OF THE DRAWINGS

Many aspects of the present embodiments can be better understood with reference to the following drawings. The components in the drawings are not necessarily drawn to scale, the emphasis instead being placed upon clearly illustrating the principles of the present embodiments. Moreover, in the drawings, all the views are schematic, and like reference numerals designate corresponding parts throughout the several views.

DETAILED DESCRIPTION

The disclosure, including the accompanying drawings, is illustrated by way of example and not by way of limitation. It should be noted that references to "an" or "one" embodiment in this disclosure are not necessarily to the same embodiment, and such references mean at least one.

Figure 1:
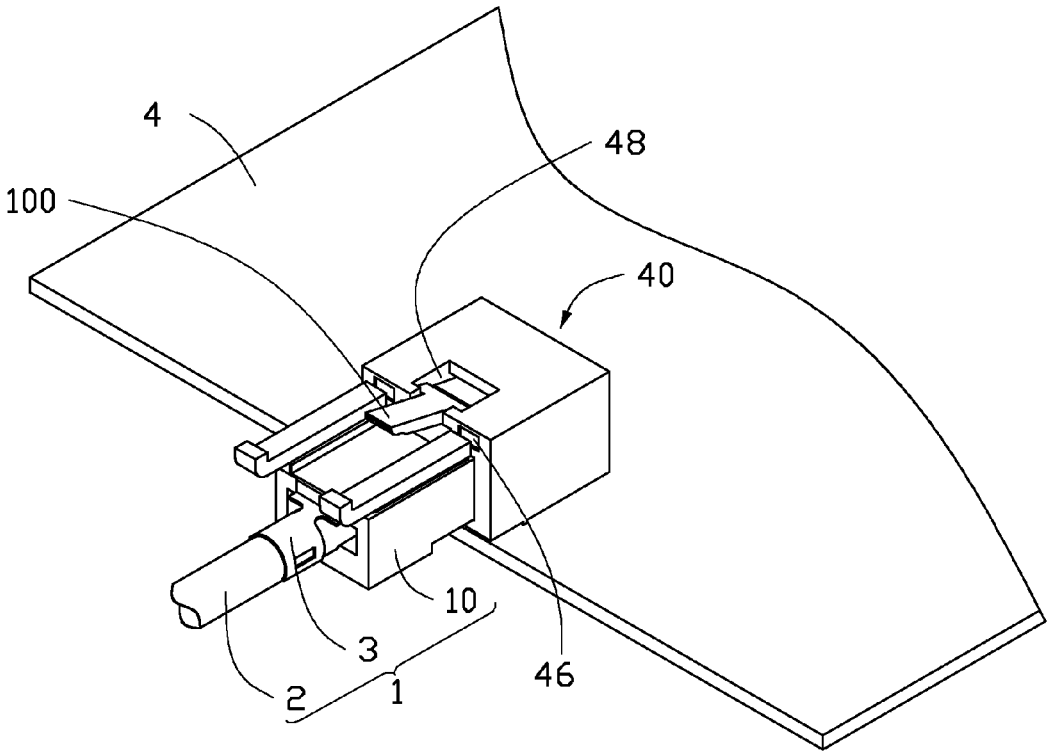
FIG. 1 is an assembled, isometric view of one embodiment of a Registered Jack-45 (RJ-45) connector and a motherboard, the RJ-45 connector including two light guide posts.

Referring to FIG. 1, one embodiment of a Registered Jack-45 (RJ-45) connector 1 includes a main body 10, a cable 2 extending from a rear end of the main body 10, and a light guide assembly 3.

An elastic latch 100 is formed on a front end of a sidewall of the main body 10 opposite to the rear end.

Figure 2:
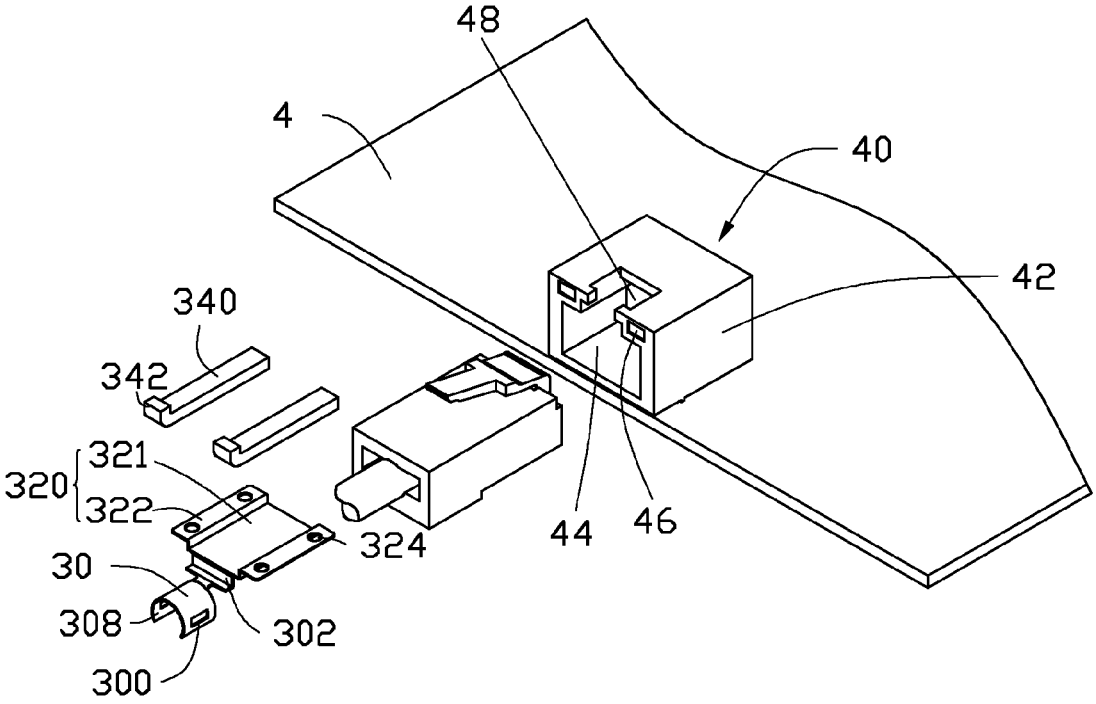
FIG. 2 is an exploded and isometric view of FIG. 1.
Figure 3:
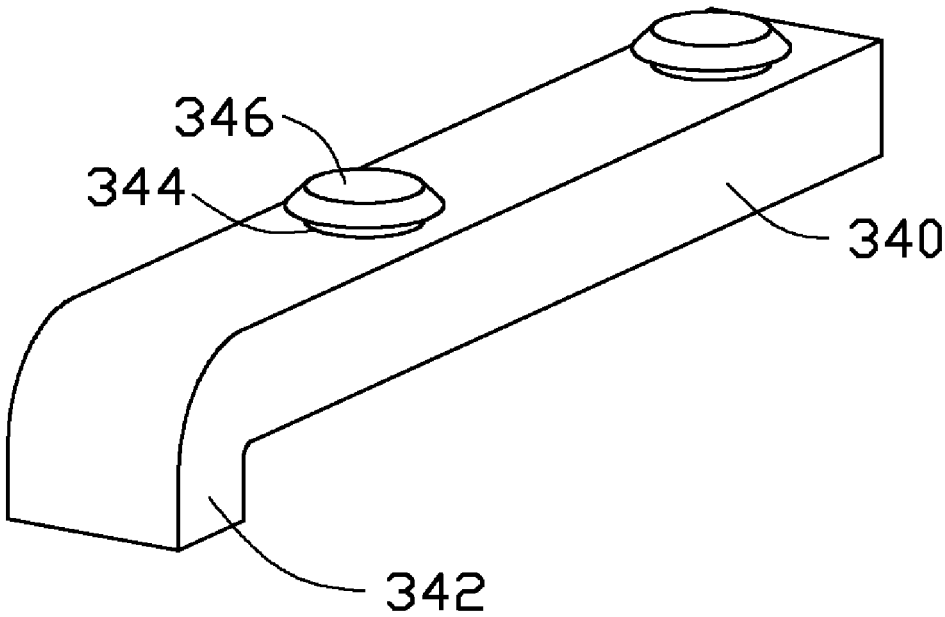
FIG. 3 is an enlarged, inverted view of one of the light guide posts of FIG. 1.

Referring to FIG. 2 and FIG. 3, the light guide assembly 3 includes a support member 320, two light guide posts 340 and a fixable member 30. The support member 320 includes a substantially U-shaped plate 321, and two support pieces 322 substantially perpendicularly extending respectively from opposite distal ends of the plate 321. Each support piece 322 defines two through holes 324 in opposite ends of the support piece 322. A protrusion 342 extends up from an end of each light guide post 340. Two posts 344 extend from opposite ends of a bottom of each light guide post 340. A tapered latch 346 extends from a distal end of each post 344. Each of the latches 346 can be deformed.

In assembling of the light guide posts 344 to the support member 320, the latches 346 of each light guide post 340 are deformed to extend through the corresponding through holes 324 of the corresponding support piece 322, with the posts 344 accommodated in the through holes 324. Therefore, the light guide posts 340 are mounted to the support member 32.

The fixable member 30 is substantially C-shaped in cross section, with a first receiving space 308 bounded by the fixable member 30. Two fixable holes 300 are defined on opposite sides of the fixable member 30. A substantially L-shaped connection portion 302 extends from an end of the fixable member 30 and is perpendicularly connected to an end of the plate 321 of the support member 320 adjacent to the protrusions 342 of the light guide posts 340, with the fixable member 30 below the plate 321.

In assembling of the light guide assembly 3 to the cable 2, the fixable member 30 movably fits about the cable 2, with the cable 2 received in the first receiving space 308 of the fixable member 30. The light guide assembly 3 is moved toward the main body 10, until the support member 320 contacts the top of the main body 10 completely.

Referring to FIG. 1 and FIG. 2 again, the RJ-45 connector 1 can be inserted into a connector 40 of a motherboard 4. The connector 40 includes a housing 42. The housing 42 defines a second receiving space 44. Two light emitting diodes 46 are mounted to a rear end of the housing 42 and above the second receiving space 44. An opening 48 is defined in a top of the housing 42, communicating with the second receiving space 44. The two light emitting diodes 46 are positioned at opposite sides of the opening 48.

In assembling of the connector 1 to the motherboard 4, the main body 10 of the connector 1 is inserted into the second receiving space 44 of the connector 40. The elastic latch 100 is engaged in the opening 48. The front end of each light guide post 340 of the light guide assembly 3 aligns with and/or resists against a corresponding light emitting diode 46. Light generated by the two light emitting diodes 46 is transmitted to the protrusions 342. Therefore, the light can easily be seen.

In other embodiments, striations, such as cable binding ribbon extend through one of the fixable holes 300 of the fixable member 30, pass by the bottom of the cable 2, and then extend through the other fixable hole 300 of the fixable member 30 to fix the light guide assembly 3 to the cable 2 tightly.

It is believed that the present embodiments and their advantages will be understood from the foregoing description, and they will be apparent that various changes may be made thereto without departing from the spirit and scope of the description or sacrificing all of their material advantages, the examples hereinbefore described merely being exemplary embodiment.

What is claimed is:

1. A Registered Jack-45 (RJ-45) connector for connecting to a connector with two light emitting diodes, the RJ-45 connector comprising:

a main body to engage with the connector;

a cable extending from a first end of the main body opposite to the connector; and a light guide assembly fitting about the cable adjacent to the main body, wherein the light guide assembly comprises two light guide posts, each light guide post comprises a front end to align with and face a corresponding light emitting diode, and a rear end opposite to the front end, the light guide posts transmit light emitted by the light emitting diodes from the front ends to the rear ends of the light guide posts.

2. The RJ-45 connector of claim 1, wherein the main body further comprises an elastic latch formed on a second end of the main body to engage with the connector.

3. The RJ-45 connector of claim 1, wherein the light guide assembly further comprises a support member and a fixable member, the support member comprises a plate contacting the top of the main body with a bottom of the support member and support the light guide posts with a top of the support member, a first end of the fixable member fits about the cable, a connection portion extends from a second end of the fixable member and is connected to the plate opposite to the connector.

4. The RJ-45 connector of claim 3, wherein the plate comprises two support pieces extending from opposite sides of the plate, at least one through hole is defined in each of the support pieces, each of the light guide posts comprises at least one post extending from a bottom of the light guide post, and a tapered latch extends from a distal end of each of the at least one post to extend through one of the at least one through hole of the support piece with the at least one post accommodated in the at least one through hole.

5. The RJ-45 connector of claim 3, wherein the fixable member is substantially C-shaped in cross section.

6. The RJ-45 connector of claim 5, wherein the fixable member defines two fixable holes in opposite sides of fixable member.

7. A Registered Jack-45 (RJ-45) connector assembly comprising:

a first connector defining a receiving space, and comprising at least one light emitting diode at a side of the first receiving space; and a second connector comprising a main body received in the receiving space of the first connector, a cable extending from a first end of the main body opposite to the first connector, and a light guide assembly to fit about the cable adjacent to the main body, the light guide assembly comprising at least one light guide post, the at least one light guide post comprising a front end to face the light emitting diode, and a rear end opposite to the front end, wherein the at least one light guide post transmits light emitted by the at least one light emitting diode from the front end to the rear end of the at least one light guide post.

8. The RJ-45 connector assembly of claim 7, wherein the first connector further defines an opening to communicate with the first receiving space; an elastic latch is formed on the main body of the second connector to engage in the opening.

9. The RJ-45 connector assembly of claim 7, wherein the number of the at least one light emitting diode is two and the at least one light guide post is two, light emitted by the light emitting diodes is transmitted by the corresponding light guide posts.

10. The RJ-45 connector of claim 7, wherein the light guide post assembly further comprises a support member and a fixable member fixing about the cable, the support member comprises a plate to contact the top of the main body with a bottom of the support member, the at least one light guide post are mounted on a top of the support member opposite to the main body, a connection portion extends from the fixable member and is connected to the plate.

11. The RJ-45 connector of claim 10, wherein at least one support piece extends from the plate, two through holes are defined in the at least one support piece, the at least one light guide post comprises two posts extending from the bottom of the at least one light guide post, and a tapered latch extending from a distal end of each post to extend through a corresponding through hole, with the latched blocked by the at least one support piece.

12. The RJ-45 connector of claim 7, wherein the fixable member is C-shaped in cross-section.

* * * * *